US007308878B2

(12) United States Patent
Kira

(10) Patent No.: US 7,308,878 B2
(45) Date of Patent: Dec. 18, 2007

(54) VALVE TIMING CONTROL APPARATUS

(75) Inventor: Naoki Kira, Kariya (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 138 days.

(21) Appl. No.: 11/367,450

(22) Filed: Mar. 6, 2006

(65) Prior Publication Data

US 2006/0201464 A1 Sep. 14, 2006

(30) Foreign Application Priority Data

Mar. 11, 2005 (JP) ..... 2005-069002

(51) Int. Cl.
*F01L 1/34* (2006.01)

(52) U.S. Cl. ..... 123/90.17; 123/90.16; 123/90.15; 123/90.31; 464/1; 464/2; 464/160; 92/120; 92/121; 92/122; 29/888.1

(58) Field of Classification Search ..... 123/90.17
See application file for complete search history.

(56) References Cited

U.S. PATENT DOCUMENTS 6,994,062 B2 * 2/2006 Kawai et al. ..... 123/90.15

7,246,581 B2 * 7/2007 Suga et al. ..... 123/90.17

FOREIGN PATENT DOCUMENTS

JP 2002-227620 1/2001

* cited by examiner

*Primary Examiner*—Thomas Denion
*Assistant Examiner*—Kyle M. Riddle
(74) *Attorney, Agent, or Firm*—Reed Smith LLP; Stanley P. Fisher, Esq.; Juan Carlos A. Marquez, Esq.

(57) ABSTRACT

A valve timing control apparatus includes a driving side rotational member, a driven side rotational member formed with a plurality of recessed portions into which a supporting jig is insertable at a second side thereof in the axial direction, a fluid pressure chamber, a vane, a lock member, and a cover plate formed with a plurality of through holes, through which the supporting jig is insertable, at a position in which each of the plurality of through holes is overlapped with each of the plurality of recessed portions of the driven side rotational member in a condition where the relative rotational phase is restrained at the lock phase.

18 Claims, 11 Drawing Sheets

VALVE TIMING CONTROL APPARATUS

This application is based on and claims priority under 35 U.S.C. § 119 to Japanese Patent Application 2005-069002, filed on Mar. 11, 2005, the entire content of which is incorporated herein by reference.

FIELD OF THE INVENTION

This invention relates to a valve timing control apparatus, which includes a driving side rotational member synchronously rotatable with a crankshaft of an internal combustion engine, and a driven side rotational member provided coaxially with the driving side rotational member and fixed to a camshaft of the internal combustion engine at a side thereof in an axial direction.

BACKGROUND

A known valve timing control apparatus for an internal combustion engine is disclosed in U.S. Pat. No. 6,382,157B1 (see columns 5-10, FIGS. 4, 11). As illustrated in FIG. 11, the disclosed valve timing control apparatus 101 includes an outer rotor 105, an inner rotor 104, advanced angle chambers 161*a*, retarded angle chambers 161*b*, and a lock member 163*a*. The outer rotor 105 is synchronously rotatable with a crankshaft of an engine and having plural shoes 155 inside thereof. The inner rotor 104 is fixed to an end portion of a camshaft of the engine and having plural vanes 144 at outside thereof. Further, the inner rotor 104 is provided in the outer rotor 105 and is relatively rotatable with the outer rotor 105. The advanced angle chambers 161*a* and the retarded angle chambers 161*b* are formed between the plural vanes 144 of the inner rotor 104 and the plural shoes 155 of the outer rotor 105. The lock member 163*a* locks the inner rotor 104 at a predetermined angle relative to the outer rotor 105. The outer rotor 105 is provided with plural projections 182 at outer circumference thereof in regular intervals. Each projection 182 protrudes outwardly in a radial direction of the outer rotor 105. Further, the projection 182 allows an engagement of a chuck tool of an automatic machine used for an auto-assembly work.

With the configuration of the valve timing control apparatus 101 disclosed in U.S. Pat. No. 6,382,157B1, the outer rotor 105 is turned in a clockwise direction in FIGS. 11-12 by means of the chuck tool of the automatic machine, and the vanes 144 of the inner rotor 104, which are fixed at a most retarded angle relative to the outer rotor 105, are firmly contacted with the shoes 155 of the outer rotor 105. Accordingly, even when a clearance is left between the lock member 163*a* and an engaging hole 163*b* into which the lock member 163*a* is inserted, the disclosed valve timing control apparatus 101 can restrain an assembling error caused by the clearance.

Further, U.S. Pat. No. 6,382,157B1 also discloses a valve timing control apparatus, which is provided with a polygonal portion 184 at an inner surface of a concave seat 183 used for seating a fixing member, by which the inner rotor 104 is fixed to the camshaft, as illustrated in FIG. 12. As well as the projection 182, the polygonal portion 184 allows the engagement of the chuck tool of the automatic machine used for the auto-assembly work.

With the configuration of the valve timing control apparatus disclosed in U.S. Pat. No. 6,382,157B1, an angle of the inner rotor 104 relative to the outer rotor 105 can be held in order to prevent the inner rotor 104 from being turned in the clockwise direction in a condition where the outer rotor 105 is turned in the clockwise direction. Accordingly, the inner rotor 104 can be fixed at the most retarded angle phase relative to the outer rotor 105.

With the configuration of the valve timing control apparatus 101 disclosed in U.S. Pat. No. 6,382,157B1, the vanes 144 of the inner rotor 104 are firmly contacted with the shoes 155 of the outer rotor 105 by applying a load to the outer rotor 105 to rotate in a predetermined direction while holding the angle of the inner rotor 104 when the valve timing control apparatus 101 is mounted to the camshaft. Accordingly, the clearance between the lock member 163*a* and the engaging hole 163*b* is biased in one direction, and the assembling error caused by the clearance is thereby restrained.

Therefore, during mounting operation, the lock member 163*a*, the engaging hole 163*b*, the vanes 144 of the inner rotor 104, and the shoes 155 of the outer rotor 105 are applied with an excessive share load, which is unlikely applied to them during normal operation of the engine. Accordingly, strength of each component of the valve timing control apparatus 101 such as the lock member 163*a*, the vanes 144, or the like, may necessarily be increased only for the mounting operation. In consequence, the apparatus may occasionally be increased in size and weight.

A need thus exists for a valve timing control apparatus, which can be reduced in size and weight by reducing an unnecessary load applied to an inner structure thereof at the time of mounting operation relative to the camshaft.

SUMMARY OF THE INVENTION

According to an aspect of the present invention, a valve timing control apparatus includes a driving side rotational member synchronously rotatable with a crankshaft of an internal combustion engine, a driven side rotational member provided coaxially with the driving side rotational member, the driven side rotational member being fixed to a camshaft of the internal combustion engine at a first side thereof in an axial direction, and being formed with a plurality of recessed portions into which a supporting jig is insertable at a second side thereof in the axial direction, a fluid pressure chamber formed at at least one of the driving side rotational member and the driven side rotational member, a vane separating the fluid pressure chamber into an advanced angle chamber and a retarded angle chamber, a lock member restraining a displacement of a relative rotational phase between the driving side rotational member and the driven side rotational member at a predetermined lock phase, and a cover plate fixed to a side of the driving side rotational member in an axial direction, the cover plate being formed with a plurality of through holes, through which the supporting jig is insertable, at a position in which each of the plurality of through holes is overlapped with each of the plurality of recessed portions of the driven side rotational member in a condition where the relative rotational phase is restrained at the lock phase.

According to another aspect of the present invention, a valve timing control apparatus includes a driving side rotational member synchronously rotatable with a crankshaft of an internal combustion engine, a driven side rotational member provided coaxially with the driving side rotational member, the driven side rotational member being fixed to a camshaft of the internal combustion engine at a first side thereof in an axial direction, and being formed with a plurality of recessed portions into which a supporting jig is insertable at a second side thereof in the axial direction, wherein at least one of the plurality of the recessed portions serves as a positioning hole formed at a position corresponding to a positioning recessed portion formed at the internal combustion engine side in such a manner that the supporting jig is insertable therethrough, a fluid pressure chamber formed at at least one of the driving side rotational member and the driven side rotational member, and a vane separating the fluid pressure chamber into an advanced angle chamber and a retarded angle chamber.

According to still another aspect of the present invention, a method for mounting a valve timing control apparatus relative to an internal combustion engine, the valve timing control apparatus including a driving side rotational member synchronously rotatable with a crankshaft of the internal combustion engine, a driven side rotational member provided coaxially with the driving side rotational member and fixed to a camshaft of the internal combustion engine at a first side thereof in an axial direction, a fluid pressure chamber formed at at least one of the driving side rotational member and the driven side rotational member, a vane separating the fluid pressure chamber into an advanced angle chamber and a retarded angle chamber, a lock member restraining a displacement of a relative rotational phase between the driving side rotational member and the driven side rotational member at a predetermined lock phase, and a cover plate fixed to a side of the driving side rotational member in an axial direction, the method includes the steps of temporarily engaging the driven side rotational member with the camshaft of the internal combustion engine, restraining the displacement of the relative rotational phase between the driving side rotational member and the driven side rotational member at the lock phase by means of the lock member, inserting a plurality of insert portions of a supporting jig into a plurality of recessed portions formed at a second side of the driven side rotational member in the axial direction through a plurality of through holes formed at the cover plate, and fixing the driven side rotational member relative to the camshaft in a condition where the supporting jig is held and a rotation thereof is prevented.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

A first embodiment of the present invention will be explained hereinbelow with reference to FIGS. 1-5. According to the first embodiment of the present invention, a valve timing control apparatus 1 is mounted to a camshaft 3 provided at an exhaust side of an engine 2 serving as an internal combustion engine.

Figure 1:
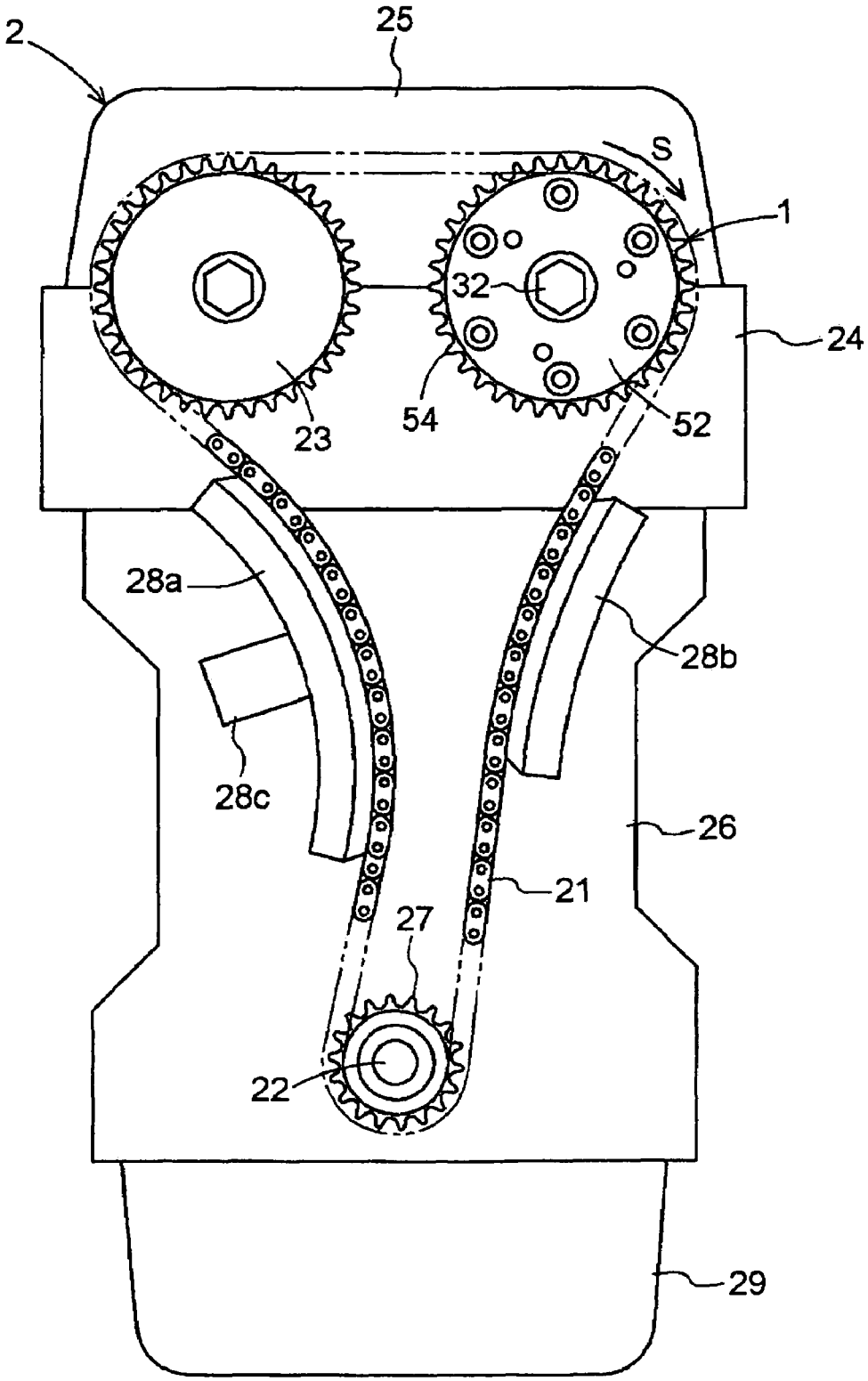
FIG. 1 is a schematic view illustrating a mounting structure of a valve timing control apparatus according to a first embodiment of the present invention relative to an engine.

As illustrated in FIGS. 1-2, the valve timing control apparatus 1 includes an inner rotor 4 serving as a driven side rotational member and an outer rotor 5 serving as a driving side rotational member. The inner rotor 4 is fixed to the camshaft 3 provided at the exhaust side of the engine 2. The outer rotor 5 is synchronously rotatably connected to a crankshaft 22 of the engine 2 through a timing chain 21 serving as a power transmission member. A normal timing sprocket (i.e. a first timing sprocket) 23 is fixed to a camshaft (not shown) provided at an inlet side of the engine 2.

The inner rotor 4 is integrally fixed to an end portion of the camshaft 3, which configures a rotational axis of a cam for controlling an opening and closing operation of an exhaust valve of the engine 2. As illustrated in FIG. 2, the inner rotor 4 is fixed to the camshaft 3 by means of a bolt (i.e. a first bolt) 32 serving as a fixing member in a condition where an engaging recessed portion 41, which is serving as an engaging portion and formed at a first side of the inner rotor 4 in an axial direction, is engaged with an engaging convex portion 31, which is serving as a portion to be engaged and formed at the end portion of the camshaft 3. More particularly, the inner rotor 4 includes the engaging recessed portion 41 at the first side thereof in the axial direction and includes a fixing hole 42, through which the first bolt 32 is insertable, at a second side thereof in the axial direction. The camshaft 3 includes, at the end portion thereof, the engaging convex portion 31, which is serving as the portion to be engaged and is engagable with the engaging recessed portion 41 of the inner rotor 4, and a contacting surface 33, which is formed in a stepwise manner relative to the engaging convex portion 31. Further, the camshaft 3 includes a female screw portion (i.e., a first female screw portion) 34, into which the first bolt 32 can be screwed, at an axle center portion thereof. The inner rotor 4 is fixed to the end portion of the camshaft 3 by screwing the first bolt 32 into the first female screw portion 34 in a condition where a first surface 43 of the inner rotor 4 in the axial direction is contacted to the contacting surface 33 of the camshaft 3, and in a condition where the engaging convex portion 31 and the engaging recessed portion 41 are engaged.

On this occasion, the camshaft 3 is rotatably connected to a cylinder head 24 of the engine 2 in such a manner that the engaging convex portion 31 formed at the end portion of the camshaft 3 is protruded from the cylinder head 24. Further, a head cover 25 is provided above the cylinder head 24 in such a manner to sandwich the camshaft 3.

Figure 4:
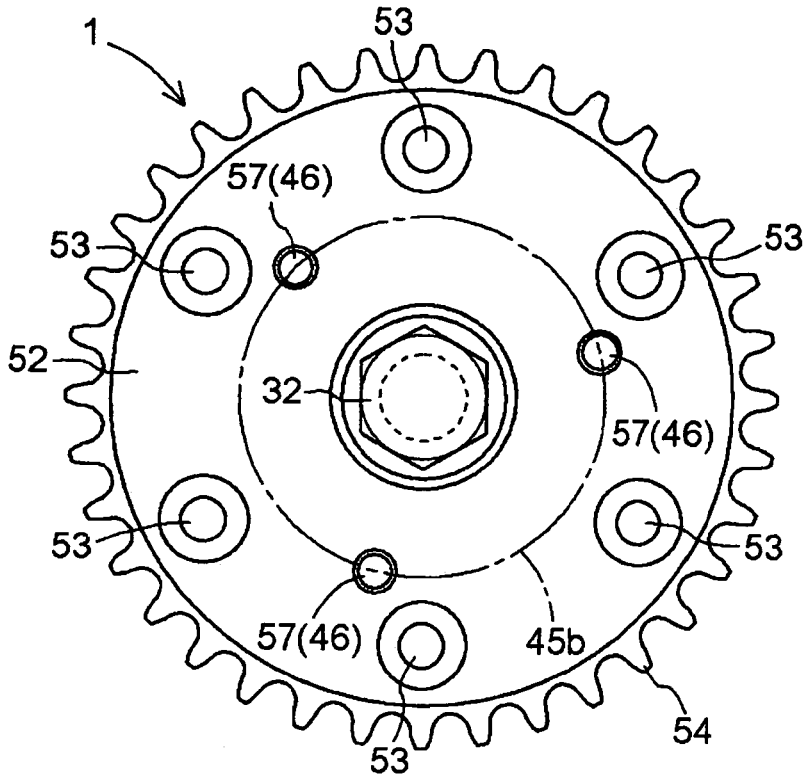
FIG. 4 is a front view of the valve timing control apparatus according to the first embodiment of the present invention.

The outer rotor 5 is relatively rotatable with the inner rotor 4 within a range of a predetermined relative rotational phase. A rear plate 51 is attached to the outer rotor 5 at a first side in an axial direction thereof to which the camshaft 3 is connected, and a cover plate 52 is attached to the outer rotor 5 at a second side in the axial direction thereof positioned at an another side against the surface to which the camshaft 3 is connected. According to the embodiment of the present invention, the cover plate 52 includes a female screw portion (i.e., a second female screw portion) into which a bolt (i.e., a second bolt) 53 serving as the fixing member is screwed as illustrated in FIGS. 2 and 4. The cover plate 52, the rear plate 51, and the outer rotor 5 are integrally fixed by screwing the second bolt 53 into the second female screw portion formed at the cover plate 52 through the rear plate 51 and the outer rotor 5. The rear plate 51 and the cover plate 52 are provided for closing an opening portion of a fluid pressure chamber 61, which is formed between the inner rotor 4 and the outer rotor 5 and opened toward the both sides in the axial direction of the inner rotor 4 and the outer rotor 5.

The outer rotor 5 is integrally provided with a timing sprocket (i.e., a second timing sprocket) 54 at an outer circumference thereof. The timing chain 21 winds around the second timing sprocket 54 of the outer rotor 5, the first timing sprocket 23 fixed to the camshaft provided at the inlet side of the engine 2, and a crankshaft sprocket 27 fixed to an end portion of the crankshaft 22 protruded from a cylinder block 26 of the engine 2. Accordingly, the outer rotor 5 is synchronously rotatable with the crankshaft 22 of the engine 2. The timing chain 21 is guided by means of guide rails 28*a* and 28*b*, and is applied with an appropriate tensile force by means of a tension adjusting device 28*c* provided at a first guide rail 28*a*.

Figure 3:
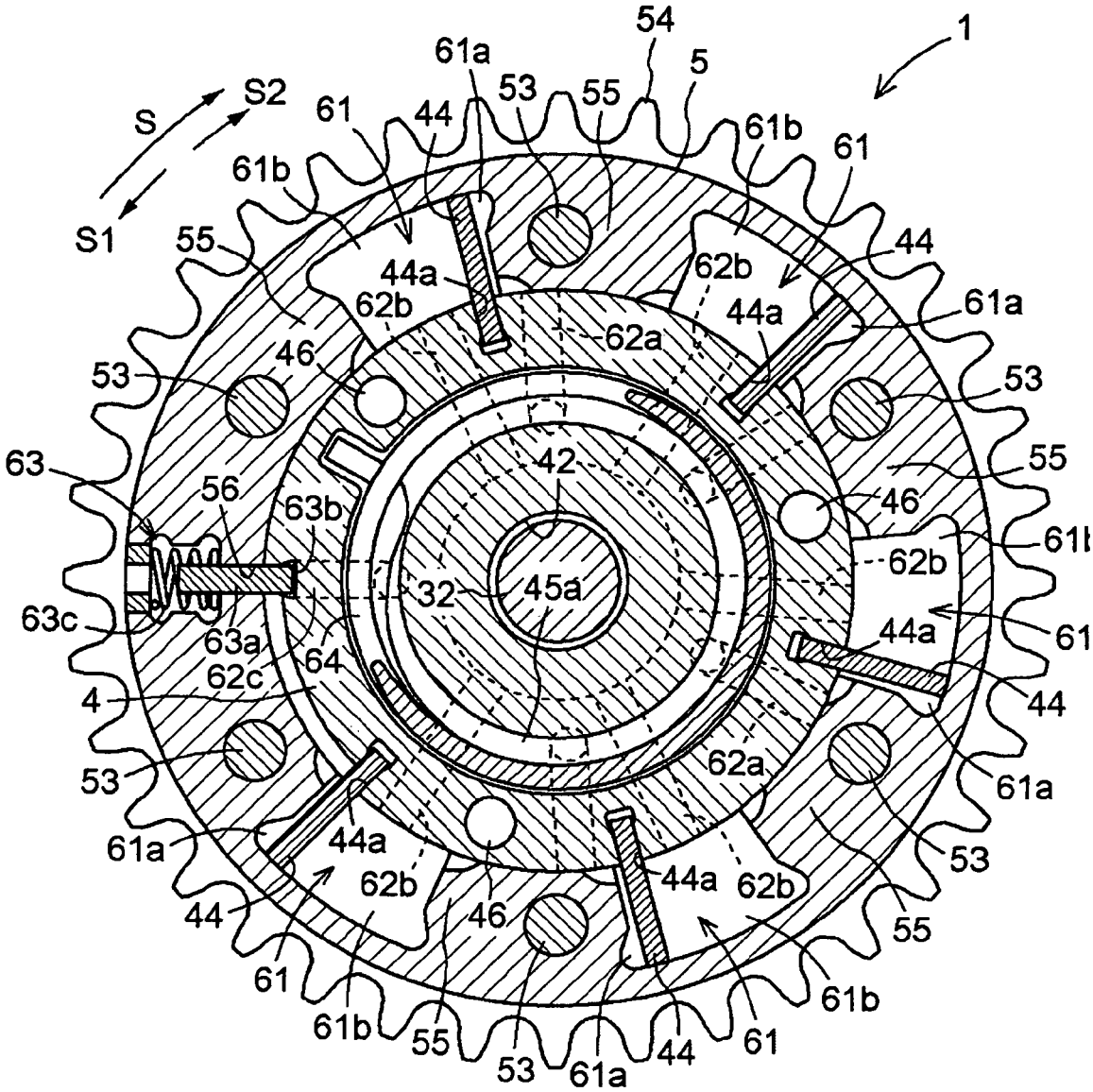
FIG. 3 is a sectional view taken along line III-III of FIG. 2.

According to the embodiment of the present invention, when the crankshaft 22 is rotary driven, a rotational power is transmitted to the second timing sprocket 54 through the timing chain 21, and the outer rotor 5 is rotary driven in a rotational direction S illustrated in FIGS. 1 and 3. Then, the inner rotor 4 is rotary driven in the rotational direction S and the camshaft 3 is thereby rotated. In consequence, the cam provided at the camshaft 3 pushes the exhaust valve of the engine 2 to open.

As illustrated in FIG. 3, the outer rotor 5 includes plural projecting portions 55, which are serving as a shoe and projected inwardly in a radial direction. The projecting portions 55 are provided along a rotational direction of the outer rotor 5 in such a manner to separate from each other. Between each adjacent projecting portion 55 of the outer rotor 5, the fluid pressure chamber 61, defined by the outer rotor 5 and the inner rotor 4, is provided. According to the embodiment of the present invention, five fluid pressure chambers 61 are provided. Alternatively, or in addition, the fluid pressure chamber 61 is formed at at least one of the outer rotor 5 and the inner rotor 4.

The inner rotor 4 is formed with vane grooves 44*a* at a part of an outer circumferential portion facing the fluid pressure chamber 61. A vane 44, which separates the fluid pressure chamber 61 into a retarded angle chamber 61*a* and an advanced angle chamber 61*b* in a relative rotational direction (a direction of arrows S1 and S2 in FIG. 3), is slidably inserted into the vane groove 44*a* in a radial direction. As illustrated in FIG. 2, the vane 44 is biased outwardly in a radial direction by means of a spring (i.e. a first spring) 44*b* provided at a side of an inner diameter of the vane 44.

The retarded angle chamber 61*a* of the fluid pressure chamber 61 communicates with a retarded angle passage 62*a* formed at the inner rotor 4, the advanced angle chamber 61*b* communicates with an advanced angle passage 62*b* formed at the inner rotor 4, and the both of the retarded and advanced angle passages 62*a* and 62*b* are connected to a fluid pressure circuit (not shown). By supplying or discharging working oil, pumped from an oil pan 29 by means of an oil pump through the fluid pressure circuit, relative to one of or both of the retarded angle chamber 62*a* and the advanced angle chamber 62*b*, a biasing force is generated. The biasing force displaces a relative rotational phase between the inner rotor 4 and the outer rotor 5 (i.e., a relative rotational phase) in a retarded direction S1 (a displace direction of a relative position of the vane 44 indicated by the arrow S1 in FIG. 3) or in an advanced direction S2 (a displace direction of the relative position of the vane 44 indicated by the arrow S2 in FIG. 3), or holds the relative rotational phase at a given phase.

Further, between the outer rotor 5 and the inner rotor 4, a lock mechanism 63 is provided, which can restrain a displacement of the relative rotational phase between the inner rotor 4 and the outer rotor 5 at a predetermined lock phase (a phase illustrated in FIG. 3). The lock mechanism 63 includes a lock member 63*a*, which is movable inwardly in the radial direction from the outer rotor 5, and a recessed lock chamber 63*b*, which is provided at the outer circumference of the inner rotor 4. The lock chamber 63*b* communicates with a lock passage 62*c* formed at the inner rotor 4, and the lock passage 62*c* connects to the fluid pressure circuit (not shown).

The lock member 63*a* is guided through a guide groove 56 provided at the outer rotor 5, and is slidable along the guide groove 56 in the radial direction of the outer rotor 5. A spring (i.e., a second spring) 63*c* biases the lock member 63*a* inwardly in the radial direction. Then the lock member 63*a* protrudes into the lock chamber 63*b* provided at the outer circumference of the inner rotor 4, and the displacement of the relative rotational phase is thereby prevented. Therefore, the relative rotational phase is restrained at the lock phase. On this occasion, the lock phase is normally set for obtaining a smooth startability of the engine. According to the embodiment of the present invention, the lock phase is set in the vicinity of a most advanced angle phase of the relative rotational phase. In contrast, the lock member 63*a* is retracted from the lock chamber 63*b* by supplying the working oil into the lock chamber 63*b* through the lock passage 62*c* from the fluid pressure circuit (not shown). More particularly, when the lock chamber 63*b* is filled with the working oil, because of a pressure of the working oil in the lock chamber 63*b*, a biasing force is generated for biasing the lock member 63*a* outwardly in the radial direction of the outer rotor 5. In a condition where the biasing force, generated by the pressure of the working oil, becomes greater degree than the biasing force of the second spring 63*c*, the lock member 63*a* is retracted from the lock chamber 63*b* and comes into a state in which the displacement of the relative rotational phase between the inner rotor 4 and the outer rotor 5 is allowed.

As illustrated in FIG. 2, a torsion spring 64 is provided between the inner rotor 4 and the cover plate 52 fixed to the outer rotor 5. A first end portion of the torsion spring 64 is fixed to a rotor side spring supporting portion 45*a*, which includes a circular recessed groove shape and is formed at a surface 45 of the inner rotor 4, and a second end portion of the torsion spring 64 is fixed to a cover side spring supporting portion 52*b*, which includes a circular recessed groove shape and is formed at a surface of the cover plate 52 facing the inner rotor 4. The surface 45 is positioned at a second side of the inner rotor 4 in the axial direction. The torsion spring 64 applies a torque, which normally biases the inner rotor 4 relative to the outer rotor 5 in a direction in which the relative rotational phase displaces in the advanced angle direction S2. Alternatively, or in addition, the torsion spring 64 may be provided between the inner rotor 4 and the rear plate 51 fixed to the outer rotor 5.

With the configuration of the valve timing control apparatus 1, the surface 45 of the inner rotor 4 is formed with plural supporting recessed portions 46 into which the supporting jig 7 is insertable. Further, the cover plate 52 fixed to the outer rotor 5 is formed with plural through holes (i.e., first through hole) 57 through which the supporting jig 7 is insertable. Each first through hole 57 is positioned in such a manner to overlap with corresponding supporting recessed portion 46 in a condition where the relative rotational phase is at the lock phase.

As illustrated in FIGS. 2 and 4, the supporting recessed portion (i.e., recessed portion) 46 formed at the inner rotor 4 includes a circular cross section. Further, the supporting recessed portion 46 includes a predetermined diameter w1, and a predetermined depth d1. According to the embodiment of the present invention, the diameter w1 of the supporting recessed portion 46 is larger than a diameter w3 of an insert portion 71 of the supporting jig 7 to some degree. Further, according to the embodiment of the present invention, three supporting recessed portions 46 are formed at the surface 45 of the inner rotor 4 in a circumferential direction in such a manner to separate from each other as illustrated in FIG. 3. Each supporting recessed portion 46 is arranged at a circumference 45*b*, which is set outside in the radial direction relative to the rotor side spring supporting portion 45*a*. Further, a center of each supporting recessed portion 46 is arranged at a position where the circumference 45*b* is divided equally among three.

As illustrated in FIG. 2, each first through hole 57 formed at the cover plate 52 includes a circular cross section. Further, the first through hole 57 includes a diameter w2 larger than the diameter w1 of the supporting recessed portion 46 to some degree. Further, as well as the supporting recessed portion 46, three first through holes 57 are formed at the cover plate 52 in a circumferential direction in such a manner to separate from each other as illustrated in FIG. 4. A center of the first through hole 57 is arranged at a position in which the first through hole 57 is overlapped with the supporting recessed portion 46 in a condition where the relative rotational phase is at the lock phase. A positional relation between a center of the first female screw portion 34 for fixing the outer rotor 5 and a center of each first through hole 57 is set in such a manner that the first through hole 57 and the supporting recessed portion 46 are overlapped in a condition where the relative rotational phase between the outer rotor 5 and the inner rotor 4 is at the lock phase.

Figure 2A:
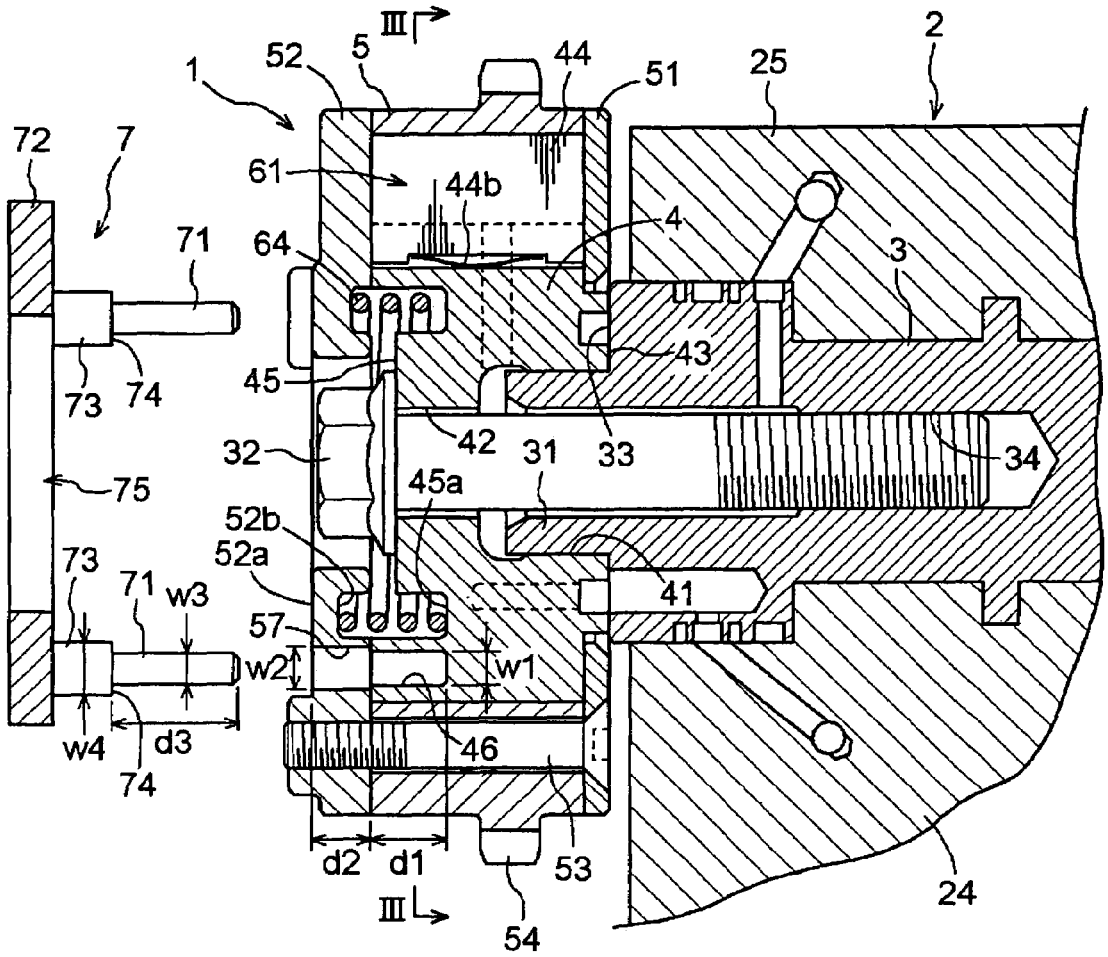
FIG. 2A is a longitudinal sectional view of the valve timing control apparatus according to the first embodiment of the present invention illustrating a condition before a supporting jig is inserted.
Figure 2B:
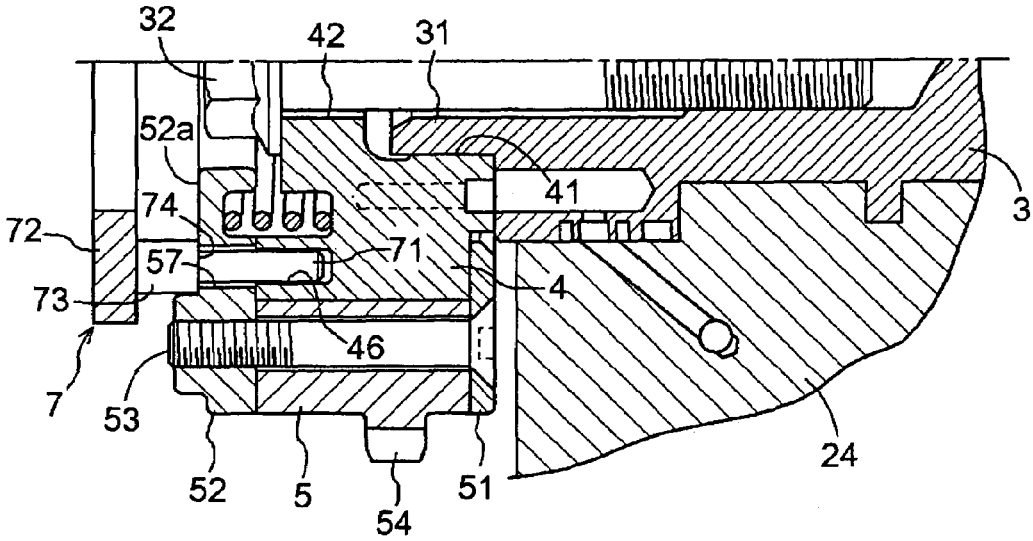
FIG. 2B is the longitudinal sectional view of the valve timing control apparatus according to the first embodiment of the present invention illustrating a condition where the supporting jig is inserted.
Figure 5:
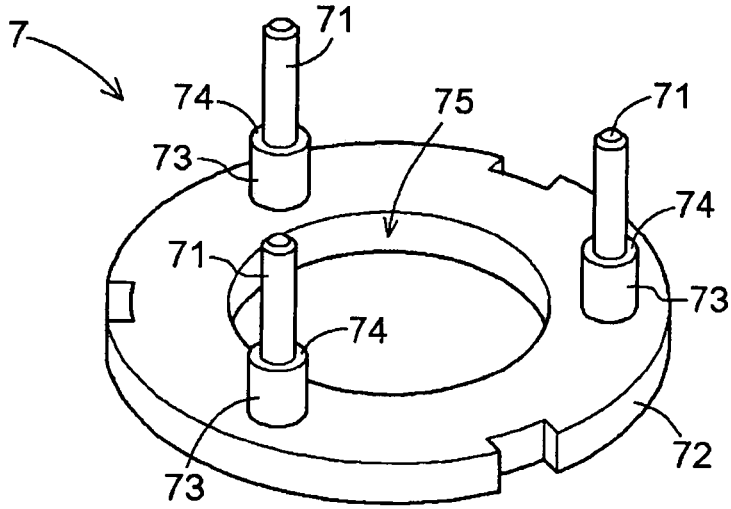
FIG. 5 is a perspective view of the supporting jig according to the first embodiment of the present invention.

As illustrated in FIGS. 2 and 5, the supporting jig 7 includes three insert portions 71 and a base plate 72. The insert portion 71 is insertable into the supporting recessed portion 46 of the inner rotor 4 and is insertable through the first through hole 57 of the cover plate 52. The base plate 72 includes a substantially ring shape and supports the insert portion 71. According to the embodiment of the present invention, the insert portion 71 includes a substantially column shape. Further, the insert portion 71 includes the diameter w3 and a depth d3. The diameter w3 is smaller than the diameter w1 of the supporting recessed portion 46 to some degree, and the dept d3 is shorter than a total of the depth d1 of the supporting recessed portion 46 and the depth d2 of the first through hole 57 ($d2<d3<d1+d2$). A base portion 73 is provided between the insert portion 71 and the base plate 72. The base portion 73 includes a substantially column shape. Further, the base portion 73 includes a larger diameter than that of the insert portion 71 to some degree. A stepped portion 74 is formed because of a difference of the diameter between the base portion 73 and the insert portion 71. The base portion 73 includes a diameter w4 larger than the diameter w2 of the first through hole 57 to some degree. By means of the base portion 73, the supporting jig 7 is inserted in such a manner that the stepped portion 74 is contacted with a surface 52*a* (a second side surface in the axial direction) of the cover plate 52 in a condition where the insert portion 71 is inserted into the supporting recessed portion 46 and the first through hole 57 as illustrated in FIG. 2B. On this occasion, the cover plate 52, the inner rotor 4, and the base plate 72 are arranged in parallel. The base plate 72 includes a substantially ring shape and supports the insert portion 71 through the base portion 73. Further, the base plate 72 includes a cutout portion 75, through which a fixing tool for fixing the first bolt 32 is insertable, at a center portion thereof.

A mounting operation of the valve timing control apparatus 1 relative to the engine 2 according to the embodiment of the present invention is explained hereinafter.

First, the inner rotor 4 of the valve timing control apparatus 1 is temporarily engaged with the end portion of the camshaft 3 by means of the first bolt 32 as illustrated in FIG. 2A. More particularly, the engaging recessed portion 41 of the inner rotor 4 is engaged with the engaging convex portion 31 of the camshaft 3, and the first surface 43 of the inner rotor 4 in the axial direction is contacted to the contacting surface 33 of the camshaft 3. Then, the first bolt 32 is inserted through the fixing hole 42 of the inner rotor 4 and is screwed into the first female screw portion 34 provided at the axle center portion of the camshaft 3, and thus a temporary engagement of the inner rotor 4 and the camshaft 3 is performed. In order to conform a phase of the camshaft with the relative rotational phase of the valve timing control apparatus 1, fixation of the valve timing control apparatus 1 to the camshaft 3 is required to perform in a condition where the relative rotational phase between the inner rotor 4 and the outer rotor 5 is restrained at the predetermined relative rotational phase. According to the embodiment of the present invention, the relative rotational phase between the inner rotor 4 and the outer rotor 5 is restrained at the lock phase by means of the lock member 63*a* during the temporary engagement.

Next, the timing chain 21 winds around the second timing sprocket 54 provided at the outer rotor 5 of the valve timing control apparatus 1, the first timing sprocket 23 fixed to the camshaft provided at the inlet side of the engine 2, and the crankshaft sprocket 27 as illustrated in FIG. 1. The timing chain 21 is applied with the tensile force by means of the tension adjusting device 28*c*. Accordingly, the camshaft 3 at the exhaust side, the camshaft (not shown) at the inlet side, and the crankshaft 22 are fixed.

Next, the insert portion 71 of the supporting jig 7 is inserted into the supporting recessed portion 46 of the inner rotor 4 and the first through hole 57 of the cover plate 52 as illustrated in FIG. 2B. Then, the first bolt 32 is fixed by means of the fixing tool inserted from the cutout portion 75 provided at a center of the base plate 72 of the supporting jig 7 in a condition where the supporting jig 7 is held and a rotation thereof is prevented. Therefore, an inner structure of the valve timing control apparatus 1 such as the lock member 63*a*, the vane 44, or the like, can be prevented from being applied with an excessive load during the fixation of the first bolt 32 because the first bolt 32 is fixed in a condition where the inner rotor 4 is directly supported by the supporting jig 7. In contrast, in a condition where the fixation of the first bolt 32 is performed without holding the inner rotor 4 by means of the supporting jig 7, a load in a rotational direction of the inner rotor 4 generated during the fixation of the first bolt 32 is applied to the inner structure of the valve timing control apparatus 1 such as the lock mechanism 63 including the lock member 63*a*, the vane 44, the vane groove 44*a*, or the like, from the inner rotor 4. With the configuration of the valve timing control apparatus 1 according to the embodiment of the present invention, the inner structure thereof may not be applied with the excessive load because the inner rotor 4 is directly supported by means of the supporting jig 7. Accordingly, the inner structure of the valve timing control apparatus 1 such as the lock member 63*a*, the vane 44, or the like, is not required to excessively increase in strength. Further, the valve timing control apparatus 1 can thereby be reduced in size and weight.

According to the embodiment of the present invention, the relative rotational phase between the inner rotor 4 and the outer rotor 5 is restrained at the lock phase when the valve timing control apparatus 1 is temporally engaged with the camshaft 3. In a condition where the relative rotational phase is not restrained at the lock phase caused by an error in operation, the supporting recessed portion 46 and the first through hole 57 are not overlapped with each other. On this occasion, the insert portion 71 of the supporting jig 7 is inserted only into the first through hole 57. More particularly, the insert portion 71 of the supporting jig 7 cannot be inserted until a condition in which the stepped portion 74 of the supporting jig 7 is contacted with the surface 52*a* of the cover plate 52. Accordingly, a worker can easily be known that the relative rotational phase between the inner rotor 4 and the outer rotor 5 is not at the lock phase, and the operation error can thereby be prevented.

A second embodiment of the present invention will be explained hereinbelow with reference to FIGS. 6-7. As well as the first embodiment of the present invention, the inner rotor 4 is formed with, at the surface 45 thereof, plural supporting recessed portions 46 into which the supporting jig 7 is insertable. According to the second embodiment of the present invention, one of the plural supporting recessed portions 46 is formed at a position corresponding to a positioning recessed portion 81 formed at the engine 2 side. Further, the one of the plural supporting recessed portions 46 serves as a positioning hole 47 through which the supporting jig 7 is insertable. Because a sectional view taken along III-Ill of FIG. 6 corresponds to FIG. 3 and a front view of the valve timing control apparatus 1 according to the second embodiment of the present invention corresponds to FIG. 4, the second embodiment of the present invention will be explained with reference to FIGS. 3-4.

As well as the first embodiment of the present invention, three supporting recessed portions 46 are formed at the surface 45 of the inner rotor 4 in the circumferential direction in such a manner to separate from each other as illustrated in FIG. 3. According to the second embodiment of the present invention, one of the supporting recessed portions 46 serves as the positioning hole 47. Hereinafter, the supporting recessed portion 46 serving as the positioning hole 47 will be mentioned as the positioning hole 47. Illustrated in FIG. 6 is a cross section of the positioning hole 47. As illustrated in FIG. 6, the positioning hole 47 of the inner rotor 4 includes a substantially circular cross section. Further, the positioning hole 47 penetrates through the inner rotor 4 from the second side of the inner rotor 4 in the axial direction to the first side of the inner rotor 4 in the axial direction. In order to improve an accuracy of a positioning of the inner rotor 4, the positioning hole 47 may include a diameter w5 in which the insert portion 71 (the diameter w3) of the supporting jig 7 is inserted leaving no space between an inner circumference of the positioning hole 47 and an outer circumference of the insert portion 71. Other than the aforementioned structure, the positioning hole 47 includes a similar structure to the supporting recessed portion 46 of the first embodiment of the present invention. Further, two of the three supporting recessed portions 46 other than the supporting recessed portion 46 serving as the positioning hole 47 include a similar structure to the supporting recessed portion 46 of the first embodiment.

According to the second embodiment of the present invention, the rear plate 51 is formed with a through hole (i.e., a second through hole) 51*a* through which the supporting jig 7 is insertable. The rear plate 51 is fixed to the outer rotor 5 at the first side in the axial direction of the inner rotor 4. The second through hole 51 a is positioned in such a manner to overlap with the positioning hole 47 in a condition where the relative rotational phase is at the lock phase. As well as the first through hole 57 formed at the cover plate 52, the second through hole 51*a* includes a substantially circular cross section. Further, the second through hole 51*a* includes the diameter w2 larger than the diameter w1 of the supporting recessed portion 46 to some degree.

Figure 6A:
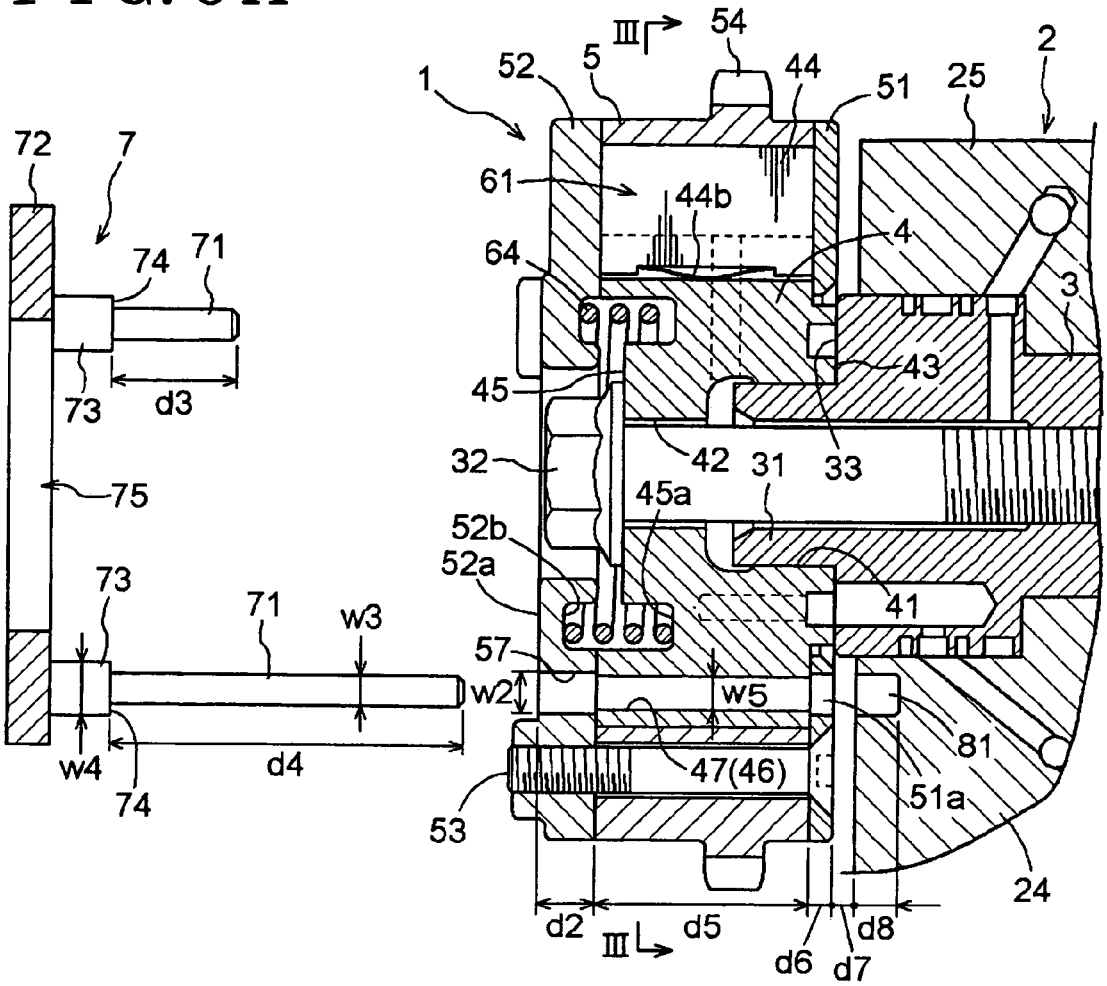
FIG. 6A is a longitudinal sectional view of a valve timing control apparatus according to a second embodiment of the present invention illustrating a condition before a supporting jig is inserted.

As illustrated in FIGS. 4 and 6, the first through hole 57 formed at the cover plate 52 according to the second embodiment of the present invention includes a similar structure to that of the first embodiment of the present invention.

According to the second embodiment of the present invention, the positioning recessed portion 81 is formed at the cylinder head 24 of the engine 2 as illustrated in FIG. 6. Further, the positioning recessed portion 81 includes a substantially oblong cross section, a major axis of which extends in a radial direction of the camshaft 3 as illustrated in FIG. 7. The positioning recessed portion 81 includes a substantially oblong cross section in order to insert the insert portion 71 of the supporting jig 7 into the positioning recessed portion 81 without difficulty through the second through hole 47 in consideration of possible deviations during production. In order to improve the accuracy of the positioning of the inner rotor 4, the positioning recessed portion 81 may include a width of the substantially oblong cross section (a crosswise length in FIG. 7) w6 in which the insert portion 71 (the diameter w3) of the supporting jig 7 is inserted leaving no space. Further, a length of the substantially oblong cross section (a vertical length in FIG. 7) w7 of the positioning recessed portion 81 may be defined in consideration of possible deviations during production.

The supporting jig 7 according to the second embodiment of the present invention includes a similar structure to the supporting jig 7 of the first embodiment of the present invention. According to the second embodiment of the present invention, one of the three insert portions 71, which is insertable into the positioning hole 47, is configured longer than other two insert portions 71 so as to reach the positioning recessed portion 81 formed at the engine 2 side. More particularly, a length d4 of the longer insert potion 71 is longer than a total length of the depth d2 of the first through hole 57 of the cover plate 52, a thickness d5 of the inner rotor 4, a depth d6 of the second through hole 51*a* of the rear plate 51, and a space d7 between the rear plate 51 and the cylinder head 24 of the engine 2 (d2+d5+d6+d7), and is shorter than a total length of d2, d5, d6, d7 and a depth d8 of the positioning recessed portion 81 (d2+d5+d6+d7+d8). In other words, d2+d5+d6+d7<d4<d2+d5+d6+d7+d8. Other than the aforementioned structure, supporting jig 7 of the second embodiment of the present invention includes a similar structure to that of the first embodiment of the present invention According to the second embodiment of the present invention, a positional relation between the positioning hole 47 and the positioning recessed portion 81 is set to satisfy the following conditions. With the configuration of the valve timing control apparatus 1 according to the second embodiment of the present invention, the inner rotor 4 and the outer rotor 5 are restrained at the lock phase by means of the lock member 63*a*, and are held by means of the supporting jig 7 by inserting the insert portion 71 thereof into the positioning recessed portion 81 through the positioning hole 47 and by inserting the insert portions 71 into the supporting recessed portions 46. Further, the crankshaft 22 is fixed by means of a fixing pin, or the like. On this occasion, the positional relation between the positioning hole 47 and the positioning recessed portion 81 is defined so that the second timing sprocket 54 of the outer rotor 5 is appropriately engaged with the timing chain 21.

Figure 6B:
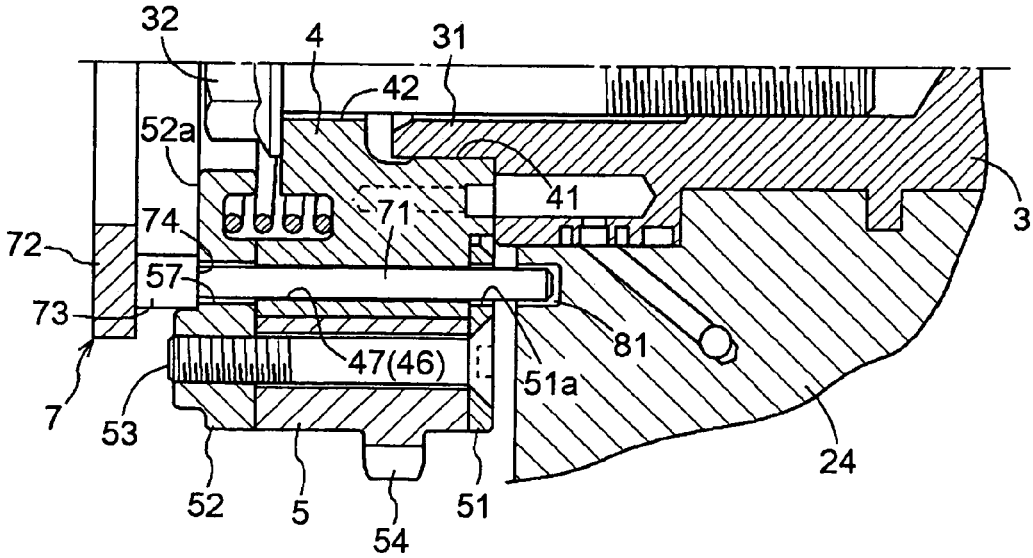
FIG. 6B is the longitudinal sectional view of the valve timing control apparatus according to the second embodiment of the present invention illustrating a condition where the supporting jig is inserted.
Figure 7:
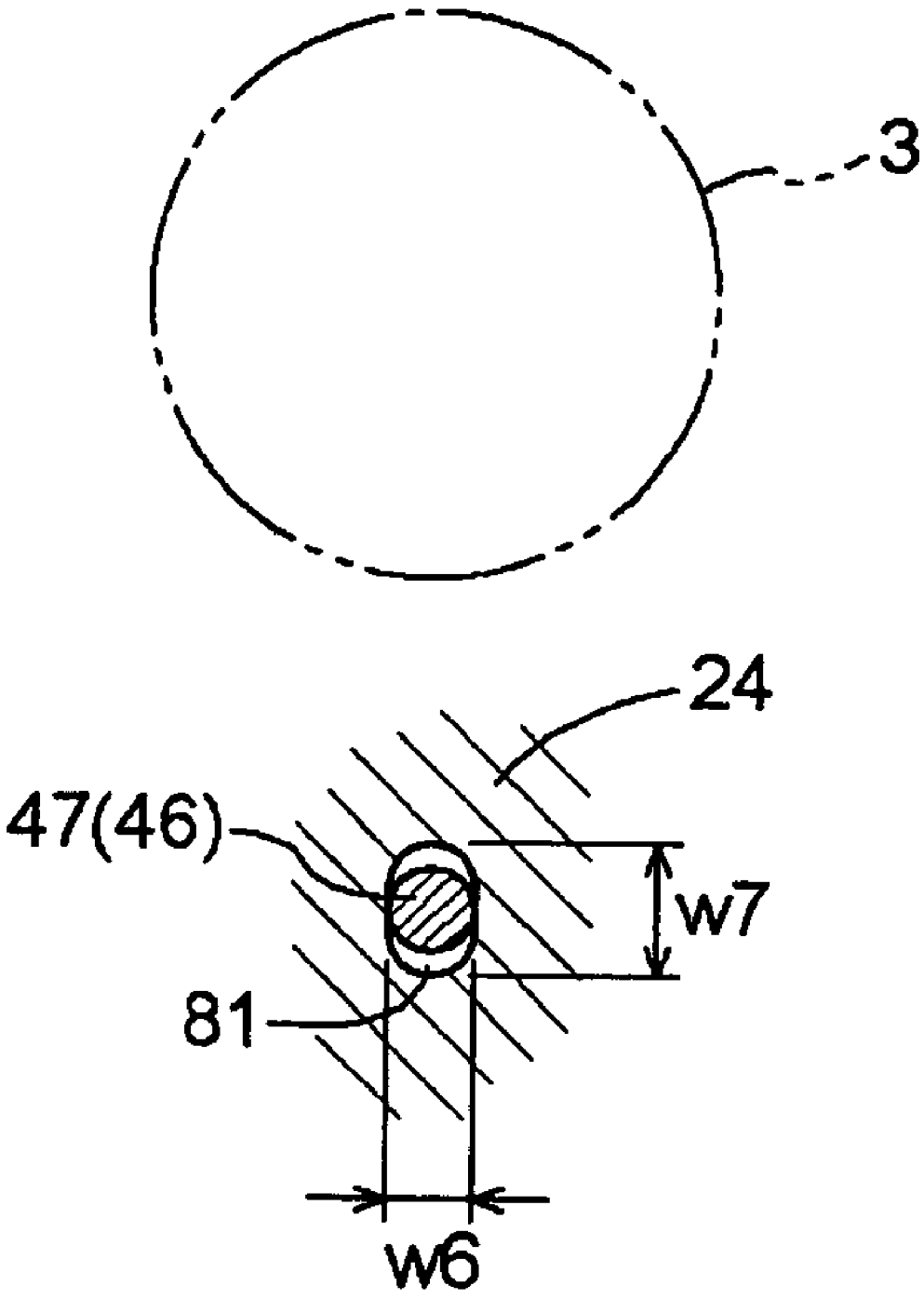
FIG. 7 is a sectional view of a positioning recessed portion of the valve timing control apparatus according to the second embodiment of the present invention.

With the configuration of the valve timing control apparatus 1 according to the second embodiment of the present invention, the inner rotor 4 can be fixed to the camshaft 3 before the timing chain 21 is wound around. More particularly, as illustrated in FIG. 6B, the first bolt 32 is fixed by means of the fixing tool inserted from the cutout portion 75 provided at the center of the base plate 72 of the supporting jig 7 in a condition where the inner rotor 4 is held by means of the supporting jig 7 by inserting the insert portion 71 thereof into the positioning recessed portion 81 through the positioning hole 47 of the inner rotor 4 and by inserting the insert portions 71 into the supporting recessed portions 46. Thereby the inner rotor 4 can be fixed at an appropriate rotational direction position. Accordingly, possible deviations during assembling caused by a clearance of the timing chain 21 can be reduced relative to a condition where the inner rotor 4 is fixed to the camshaft 3 in a condition where a positioning of the inner rotor 4 is performed by winding the timing chain 21. Further, according to the second embodiment of the preset invention, an assembling operation of the valve timing control apparatus 1 can be eased because a winding operation of the timing chain 21 is performed after the inner rotor 4 is fixed.

According to the embodiments of the present invention, the valve timing control apparatus 1 includes the lock mechanism 63 having the lock member 63*a*. Alternatively, or in addition, the valve timing control apparatus 1 may include the lock mechanism 63 without the lock member 63*a*. However, in this case, the positional relation between the positioning hole 47 and the positioning recessed portion 81 is defined to satisfy the conditions similar to the aforementioned embodiments in a condition where the inner rotor 4 and the outer rotor 5 are restrained at, for example, a most advanced angle phase or the most retarded angle phase.

According to the embodiments of the present invention, one of the plural supporting recessed portions 46 serves as the positioning hole 47. Alternatively, or in addition, more than one supporting recessed portions 46 or all supporting recessed portions 46 may serve as the positioning hole 47. On this occasion, alternatively, or in addition, the positioning recessed portion 81 at the engine 2 side may be provided at the head cover 25, or the like. Further, depending on a structure of the engine 2, the positioning recessed portion 81 may be provided at the cylinder block 26.

According to the embodiments of the present invention, the supporting recessed portions 46 and the first through holes 57 are formed at a predetermined circumference in regular intervals as illustrated in FIGS. 3-4. Alternatively or in addition, the supporting recessed portions 46 and the first through holes 57 may be formed at the predetermined circumference in irregular intervals. Further, the supporting recessed portions 46 and the first through holes 57 may be formed at a position different in the radial direction. With such configurations, the supporting jig 7 is inserted into the supporting recessed portions 46 and the first through holes 57 only in a condition where the inner rotor 4 and the outer rotor 5 are restrained at a predetermined angle in a rotational direction. Accordingly, even in a condition where some of the supporting recessed portions 46 serve as the positioning hole 47, in other words, even in a condition where some of the insert portions 71 of the supporting jig 7 are longer than others, the supporting jig 7 is prevented from inserting into the supporting recessed portions 46 and the first through holes 57 from an incorrect angle.

Figure 8A:
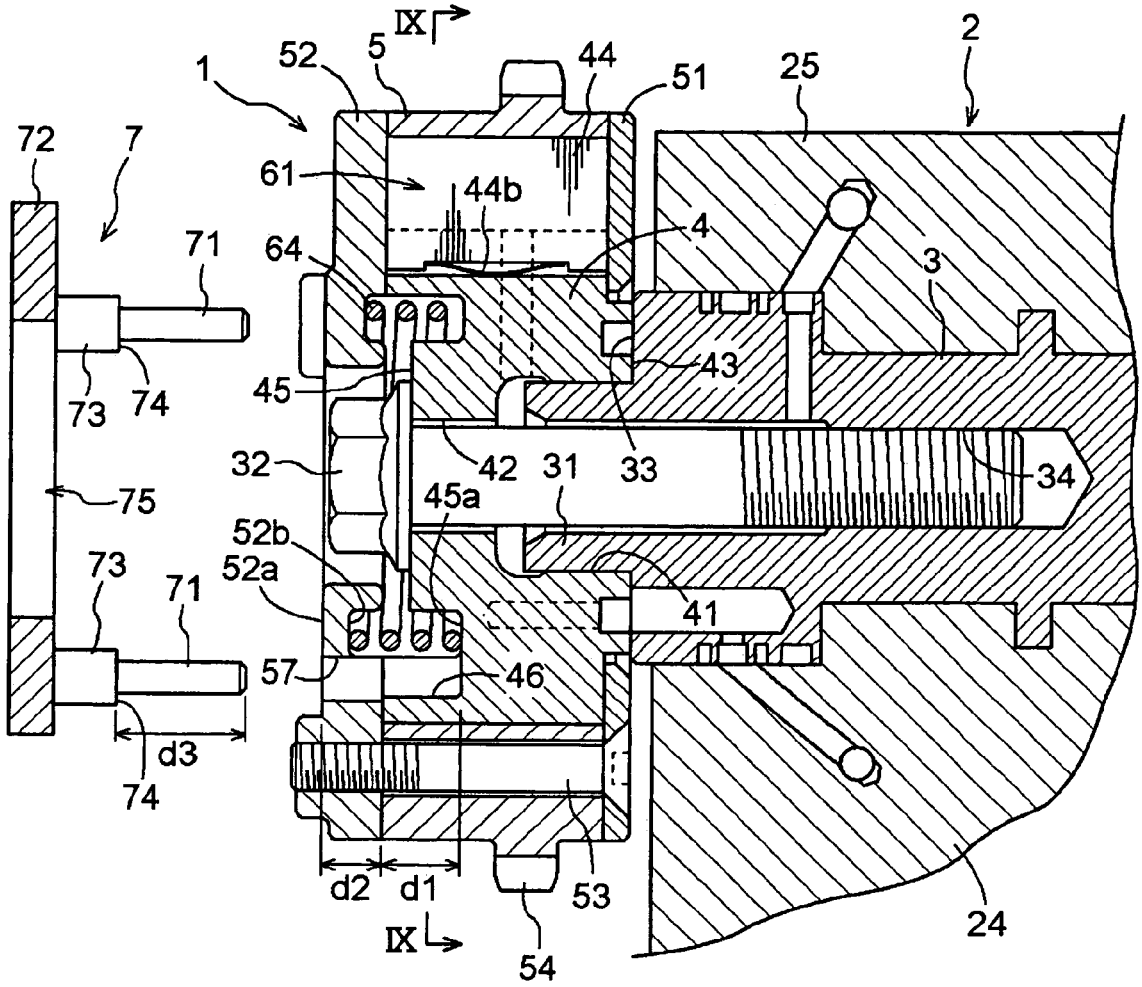
FIG. 8A is a longitudinal sectional view of a valve timing control apparatus according to a third embodiment of the present invention illustrating a condition before a supporting jig is inserted.
Figure 8B:
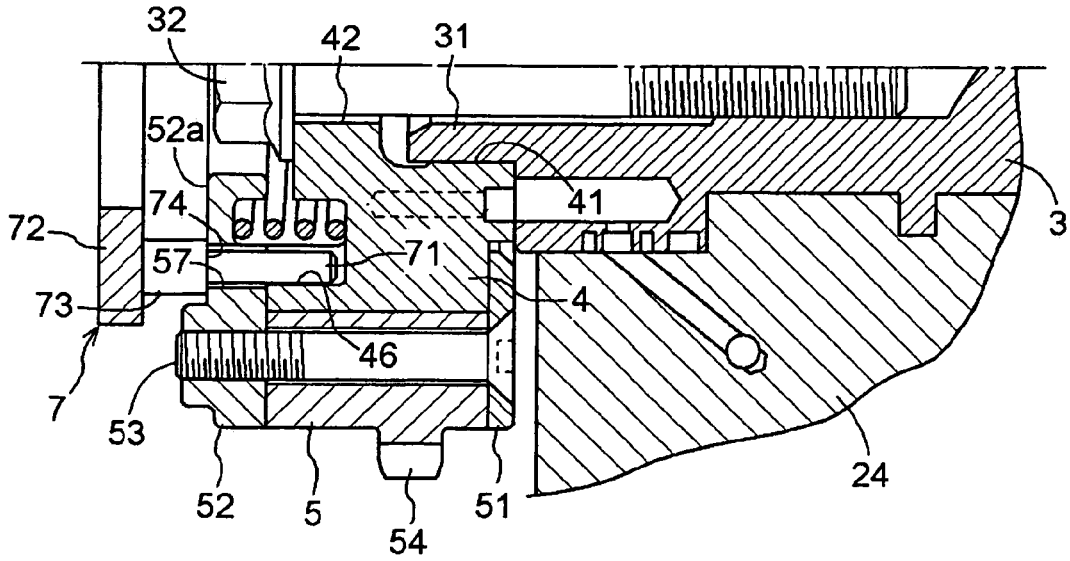
FIG. 8B is the longitudinal sectional view of the valve timing control apparatus according to the third embodiment of the present invention illustrating a condition where the supporting jig is inserted.
Figure 9:
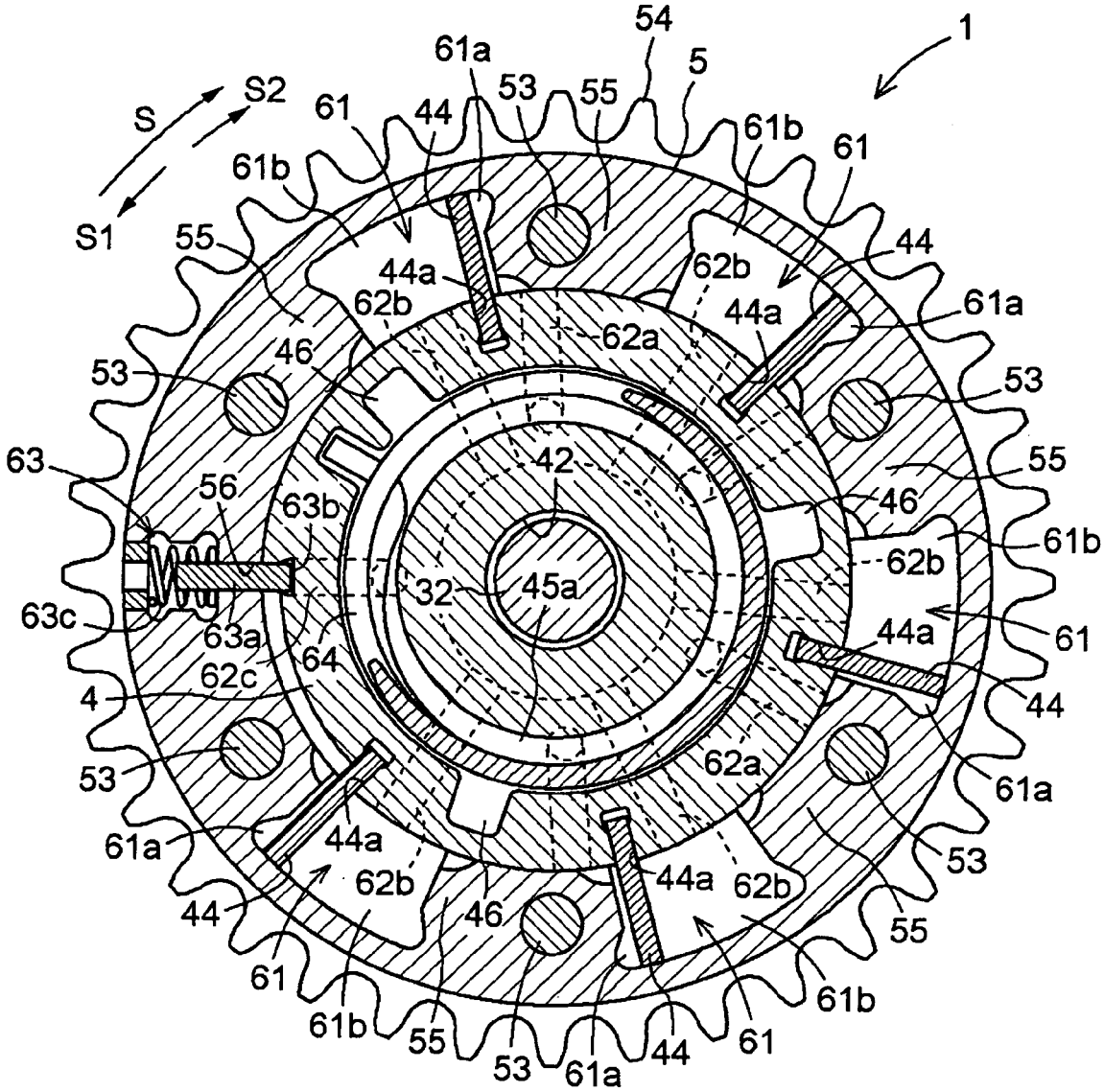
FIG. 9 is a sectional view taken along line IX-IX of FIG. 8.
Figure 10:
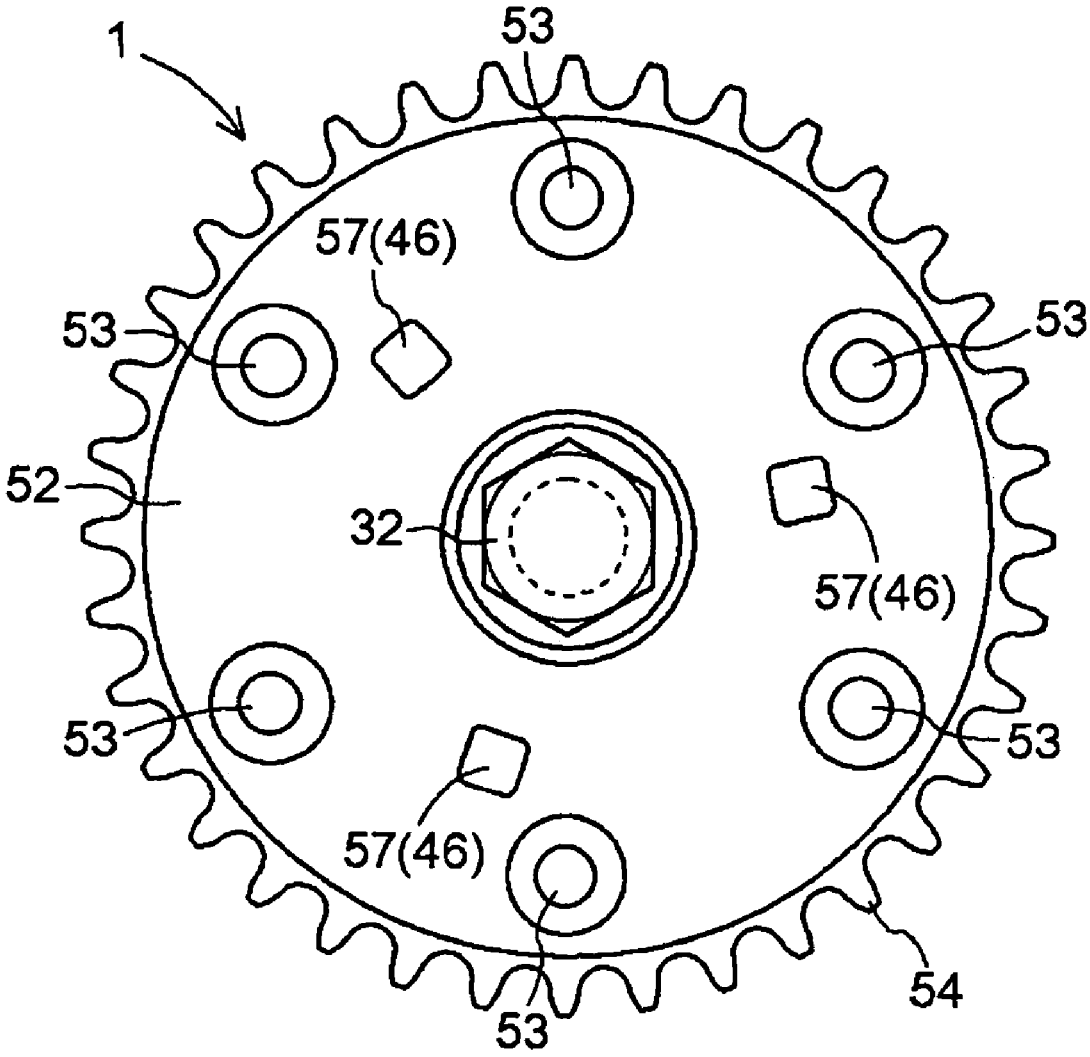
FIG. 10 is a front view of the valve timing control apparatus according to the third embodiment of the present invention.
Figure 11:
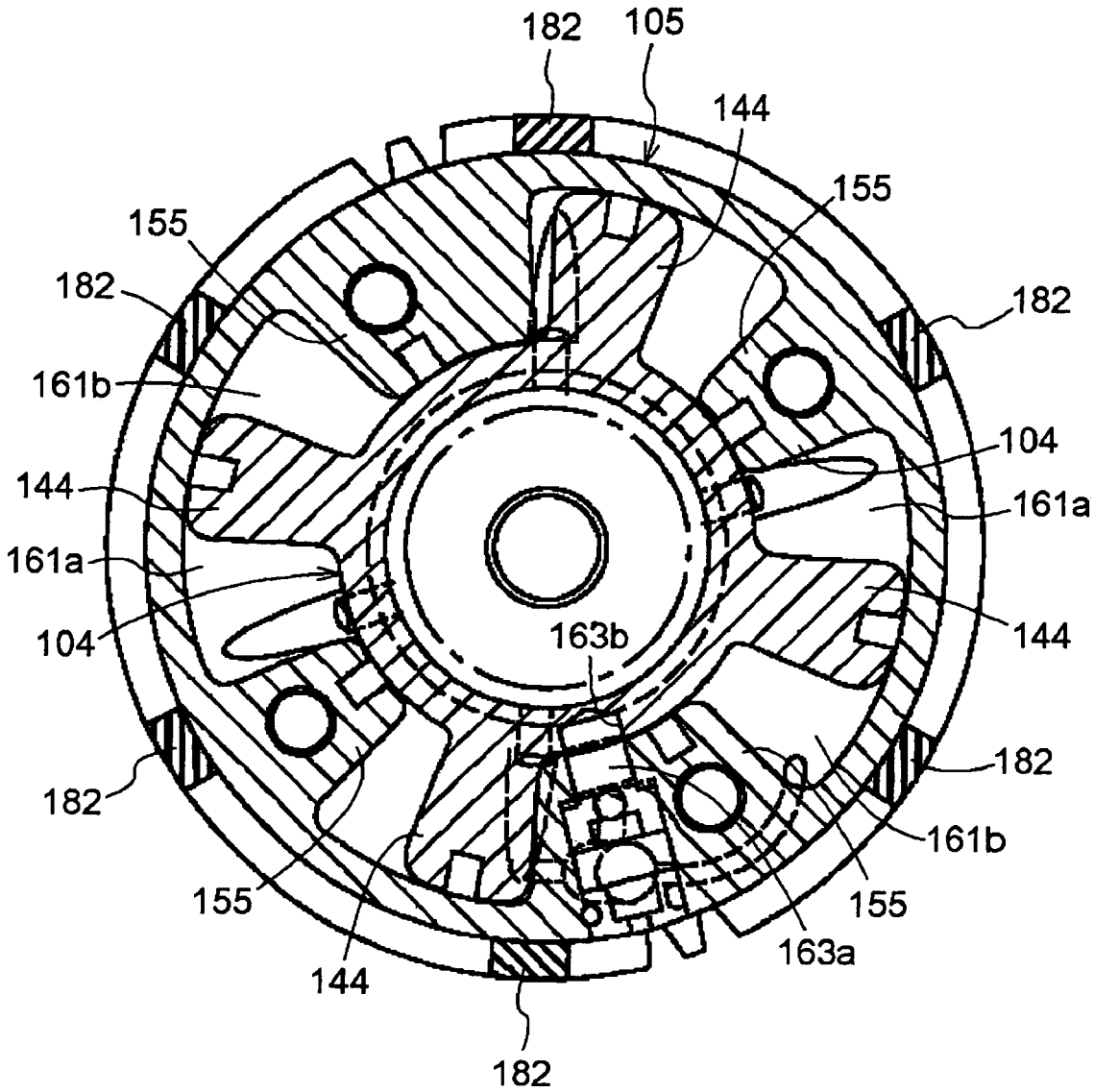
F I G. 11 Prior art
FIG. 11 is a view illustrating a structure of a valve timing control apparatus according to a related art (first example).
Figure 12:
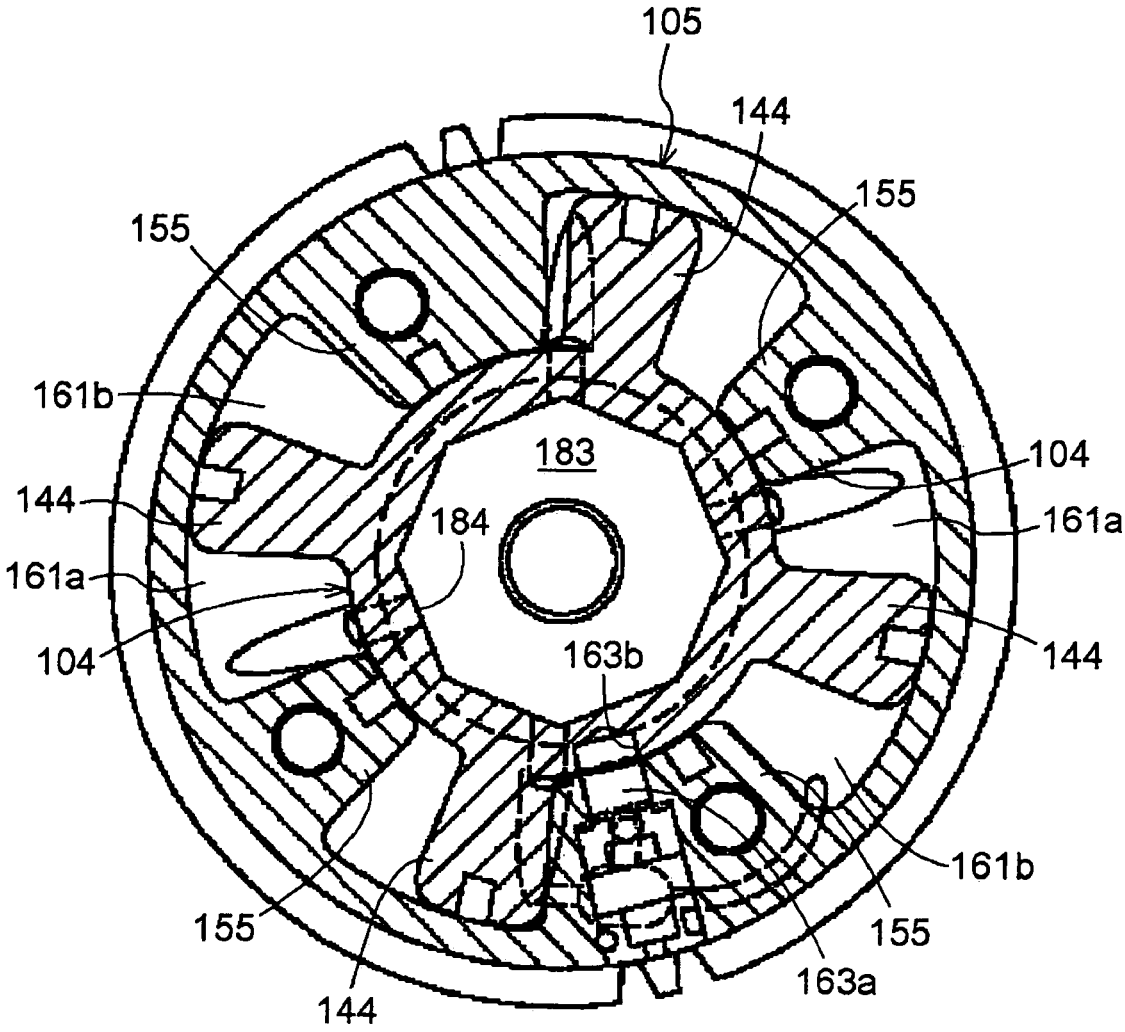
F I G. 12 Prior art
FIG. 12 is a view illustrating the structure of the valve timing control apparatus according to the related art (second example).

A third embodiment of the present invention will be explained hereinbelow with reference to FIGS. 8-10. According to the third embodiment of the present invention, the supporting recessed portion 46 of the inner rotor 4 is formed into a groove shape including a substantially quadrangular cross section and opens toward the rotor side spring supporting portion 45*a* by which the torsion spring 64 is supported. Further, the first through hole 57 formed at the cover plate 52 includes a substantially quadrangular cross section. Other than the aforementioned structure, the valve timing control apparatus 1 includes a similar structure to that of the first embodiment of the present invention. As indicated by the third embodiment of the present invention, a cross section of the supporting recessed portions 46 of the inner rotor 4 and that of the first through hole 57 of the cover plate 52 is not limited to a substantially circular shape. Further, the cross section of the supporting recessed portions 46 of the inner rotor 4 and that of the first through hole 57 of the cover plate 52 may include various shapes.

According to the embodiments of the present invention, three supporting recessed portions 46 of the inner rotor 4 are formed in the circumferential direction in such a manner to separate from each other. However, the number of the supporting recessed portions 46 is not limited thereto. The present invention is applicable as long as more than one supporting recessed portions 46 are provided in such a manner that the supporting recessed portions 46 are not interference with the vane 44, the lock member 63*a*, or the like. According to the embodiments of the present invention, the timing chain 21 is provided serving as the power transmission member. However, the present invention is not limited thereto. Alternatively, or in addition, a timing belt, or the like, may be provided serving as the power transmission member. According to the embodiments of the present invention, the valve timing control apparatus 1 is mounted to the camshaft 3 provided at the exhaust side of the engine 2. However, the present invention is not limited thereto. Alternatively, or in addition, the valve timing control apparatus 1 may be mounted to the camshaft provided at the inlet side of the engine 2. Further, alternatively, or in addition, the valve timing control apparatus 1 may be mounted to both camshafts provided at the exhausted side of the engine 2 and the inlet side of the engine 2. According to the embodiments of the present invention, the lock member 63*a* is configured to protrude from the outer rotor 5 toward the inner rotor 4. However, the present invention is not limited thereto. Alternatively, or in addition, the lock member 63*a* may be configured to protrude from the inner rotor 4 toward the outer rotor 5. According to the embodiments of the present invention, the lock member 63*a* includes a substantially flat plate. However, the present invention is not limited thereto. Alternatively, or in addition, the lock member 63*a* may include various shapes such as a substantially pin shape, or the like.

With the configuration of the valve timing control apparatus according to the embodiments of the present invention, the driven side rotational member can be directly supported by means of the supporting jig by inserting the supporting jig into the plural recessed portions formed at the driven side rotational member through the first through holes of the cover plate in a condition where the relative rotational phase between the driven side rotational member and the driving side rotational member is restrained by means of the lock member. Accordingly, the inner structure of the valve timing control apparatus such as the lock member, the vane, or the like, can be prevented from being applied with the excessive load at the time of fixation of the driven side rotational member relative to the camshaft by means of the fixing member such as the bolt, or the like. In consequence, the inner structure of the valve timing control apparatus is not required to excessively increase in strength. Further, the valve timing control apparatus can thereby be reduced in size and weight.

At the time of the fixation of the driven side rotational member relative to the camshaft, the relative rotational phase between the driven side rotational member and the driving side rotational member is required to be restrained at the predetermined phase. According to the embodiments of the present invention, the through hole of the cover plate and the recessed portion of the driven side rotational member are not overlapped in a condition where the relative rotational phase between the driven side rotational member and the driving side rotational member is not restrained at the lock phase by means of the lock member. In such a condition, the supporting jig cannot be inserted into the recessed portion formed at the driven side rotational member. Accordingly, the relative rotational phase between the driven side rotational member and the driving side rotational member can be firmly restrained at the lock phase at the time of the fixation of the driven side rotational member relative to the camshaft. In consequence, the error in operation can be prevented.

With the configuration of the valve timing control apparatus according to the embodiments of the present invention, the driven side rotational member can be positioned with sufficient accuracy relative to the operating components of the internal combustion engine side such as the camshaft, the cylinder head, the cylinder block, or the like, by inserting the supporting jig into the positioning recessed portion formed at the internal combustion engine side through the positioning hole formed at the driven side rotational member. Accordingly, a positioning relation between the crankshaft and the driving side rotational member also becomes highly precise. In consequence, the operating components such as the power transmission member for synchronously rotating the crankshaft and the driving side rotational member can be assembled without difficulty.

At the time of the fixation of the driven side rotational member relative to the camshaft, the relative rotational phase between the driven side rotational member and the driving side rotational member is required to be restrained at the predetermined phase. According to the embodiments of the present invention, the through hole of the cover plate and the recessed portion of the driven side rotational member are not overlapped in a condition where the relative rotational phase between the driven side rotational member and the driving side rotational member is not restrained at the lock phase by means of the lock member. In such a condition, the supporting jig cannot be inserted into the recessed portion formed at the driven side rotational member. Accordingly, the relative rotational phase between the driven side rotational member and the driving side rotational member can be firmly restrained at the lock phase at the time of the fixation of the driven side rotational member relative to the camshaft. In consequence, the error in operation can be prevented.

The principles, preferred embodiment and mode of operation of the present invention have been described in the foregoing specification. However, the invention which is. intended to be protected is not to be construed as limited to the particular embodiment disclosed. Further, the embodiment described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus comprising:

a driving side rotational member synchronously rotatable with a crankshaft of an internal combustion engine;

a driven side rotational member provided coaxially with the driving side rotational member, the driven side rotational member being fixed to a camshaft of the internal combustion engine at a first side thereof in an axial direction, and being formed with a plurality of recessed portions into which a supporting jig is insertable at a second side thereof in the axial direction;

a fluid pressure chamber formed at at least one of the driving side rotational member and the driven side rotational member;

a vane separating the fluid pressure chamber into an advanced angle chamber and a retarded angle chamber;

a lock member restraining a displacement of a relative rotational phase between the driving side rotational member and the driven side rotational member at a predetermined lock phase; and a cover plate fixed to a side of the driving side rotational member in an axial direction, the cover plate being formed with a plurality of through holes, through which the supporting jig is insertable, at a position in which each of the plurality of through holes is overlapped with each of the plurality of recessed portions of the driven side rotational member in a condition where the relative rotational phase is restrained at the lock phase.

2. The valve timing control apparatus according to claim 1, wherein the plurality of recessed portions formed at the driven side rotational member and the plurality of through holes formed at the cover plate are arranged on a common circumference centering on an axis of the driven side rotational member.

3. The valve timing control apparatus according to claim 2, wherein the plurality of recessed portions and the plurality of through holes are arranged on the common circumference in a rotational direction in regular intervals.

4. The valve timing control apparatus according to claim 2, wherein the plurality of recessed portions and the plurality of through holes are arranged on the common circumference in a rotational direction in irregular intervals.

5. The valve timing control apparatus according to claim 1, wherein the valve timing control apparatus further comprises a torsion spring biasing the driven side rotational member relative to the driving side rotational member in a rotational direction, wherein the driven side rotational member is formed with a spring supporting portion, which includes a circular recessed groove shape and supports at least one end of the torsion spring in an axial direction of the torsion spring, at the one side of the driven side rotational member in the axial direction, and wherein at least one of the plurality of the recessed portions formed at the driven side rotational member is formed into a groove shape which opens toward the spring supporting portion.

6. A valve timing control apparatus comprising:

a driving side rotational member synchronously rotatable with a crankshaft of an internal combustion engine;

a driven side rotational member provided coaxially with the driving side rotational member, the driven side rotational member being fixed to a camshaft of the internal combustion engine at a first side thereof in an axial direction, and being formed with a plurality of recessed portions into which a supporting jig is insertable at a second side thereof in the axial direction, wherein at least one of the plurality of the recessed portions serves as a positioning hole formed at a position corresponding to a positioning recessed portion formed at the internal combustion engine side in such a manner that the supporting jig is insertable therethrough;

a fluid pressure chamber formed at at least one of the driving side rotational member and the driven side rotational member; and a vane separating the fluid pressure chamber into an advanced angle chamber and a retarded angle chamber.

7. The valve timing control apparatus according to claim 6, wherein the plurality of recessed portions formed at the driven side rotational member are arranged on a common circumference centering on an axis of the driven side rotational member.

8. The valve timing control apparatus according to claim 7, wherein the plurality of recessed portions are arranged on the common circumference in a rotational direction in regular intervals.

9. The valve timing control apparatus according to claim 7, wherein the plurality of recessed portions are arranged on the common circumference in a rotational direction in irregular intervals.

10. The valve timing control apparatus according to claim 6, wherein the valve timing control apparatus further comprises a lock member restraining a displacement of a relative rotational phase between the driving side rotational member and the driven side rotational member at a predetermined lock phase, and a cover plate fixed to a side of the driving side rotational member in an axial direction, wherein the cover plate is formed with a plurality of through holes, through which the supporting jig is insertable, at a position in which each of the plurality of through holes is overlapped with each of the plurality of recessed portions in a condition where the relative rotational phase is restrained at the lock phase.

11. The valve timing control apparatus according to claim 6, wherein the valve timing control apparatus further comprises a torsion spring biasing the driven side rotational member relative to the driving side rotational member in a rotational direction, wherein the driven side rotational member is formed with spring supporting portions, which include a circular recessed groove shape and support at least one end of the torsion spring in an axial direction of the torsion spring, at the one side of the driven side rotational member in the axial direction, and wherein at least one of the plurality of the recessed portions formed at the driven side rotational member is formed into a groove shape which opens toward the spring supporting portion.

12. The valve timing control apparatus according to claim 10, wherein the valve timing control apparatus further comprises a torsion spring provided between the driven side rotational member and the cover plate for biasing the driven side rotational member relative to the driving side rotational member in a rotational direction, wherein the driven side rotational member is formed with a spring supporting portion, which includes a circular recessed groove shape and supports at least one end of the torsion spring in an axial direction of the torsion spring, at the second side of the driven side rotational member in the axial direction, and wherein at least one of the plurality of the recessed portions formed at the driven side rotational member is formed into a groove shape which opens toward the spring supporting portion.

13. A method for mounting a valve timing control apparatus relative to an internal combustion engine, the valve timing control apparatus comprising:

a driving side rotational member synchronously rotatable with a crankshaft of the internal combustion engine;

a driven side rotational member provided coaxially with the driving side rotational member and fixed to a camshaft of the internal combustion engine at a first side thereof in an axial direction;

a fluid pressure chamber formed at at least one of the driving side rotational member and the driven side rotational member;

a vane separating the fluid pressure chamber into an advanced angle chamber and a retarded angle chamber;

a lock member restraining a displacement of a relative rotational phase between the driving side rotational member and the driven side rotational member at a predetermined lock phase; and a cover plate fixed to a side of the driving side rotational member in an axial direction, the method comprising the steps of:

temporarily engaging the driven side rotational member with the camshaft of the internal combustion engine;

restraining the displacement of the relative rotational phase between the driving side rotational member and the driven side rotational member at the lock phase by means of the lock member;

inserting a plurality of insert portions of a supporting jig into a plurality of recessed portions formed at a second side of the driven side rotational member in the axial direction through a plurality of through holes formed at the cover plate; and fixing the driven side rotational member relative to the camshaft in a condition where the supporting jig is held and a rotation thereof is prevented.

14. The method for mounting the valve timing control apparatus relative to the internal combustion engine according to claim 13, wherein at least one of the plurality of the recessed portions formed at the driven side rotational member serves as a positioning hole formed at a position corresponding to a positioning recessed portion formed at the internal combustion engine side in such a manner that the supporting jig is insertable therethrough, the method further comprises the step of:

inserting at least one of the insert portions of the supporting jig into the positioning recessed portion formed at the internal combustion engine side through the through hole of the cover plate and the positioning hole of the driven side rotational member.

15. The method for mounting the valve timing control apparatus relative to the internal combustion engine according to claim 13, wherein the recessed portions formed at the driven side rotational member are arranged on a common circumference in a rotational direction in regular intervals.

16. The method for mounting the valve timing control apparatus relative to the internal combustion engine according to claim 13, wherein the recessed portions formed at the driven side rotational member are arranged on a common circumference in a rotational direction in irregular intervals.

17. The method for mounting the valve timing control apparatus relative to the internal combustion engine according to claim 14, wherein the recessed portions formed at the driven side rotational member are arranged on a common circumference in a rotational direction in regular intervals.

18. The method for mounting the valve timing control apparatus relative to the internal combustion engine according to claim 14, wherein the recessed portions formed at the driven side rotational member are arranged on a common circumference in a rotational direction in irregular intervals.

* * * * *